United States Patent [19]

Wons et al.

[11] 4,408,520

[45] Oct. 11, 1983

[54] APPARATUS FOR MEASURING PLATEN-PRESS BEND IN PLATEN PRESS

[75] Inventors: Hubert Wons, Brüggen; Hans-Dietrich Sitzler, Nettetal, both of Fed. Rep. of Germany

[73] Assignee: G. Siempelkamp GmbH & Co., Krefeld, Fed. Rep. of Germany

[21] Appl. No.: 340,797

[22] Filed: Jan. 19, 1982

[30] Foreign Application Priority Data

Jan. 20, 1981 [DE] Fed. Rep. of Germany ..... 3101616

[51] Int. Cl.[3] ..... B30B 7/02; B30B 15/28; B30B 15/34

[52] U.S. Cl. ..... 100/93 P; 100/46

[58] Field of Search ..... 100/93 R, 46, 99, 258 R, 100/258 A; 73/780, 818, 825, 862.54; 425/138, 140, 150, 167, 170, 171

[56] References Cited

U.S. PATENT DOCUMENTS

| | | | |
|---|---|---|---|
| 150,115 | 4/1874 | Weston et al. | 73/862.54 |
| 2,627,289 | 2/1953 | Berthelsen | 100/93 P |
| 3,640,660 | 2/1972 | DeMets | 425/140 |
| 3,729,985 | 5/1973 | Sikorra | 73/780 |
| 3,952,879 | 4/1976 | Grove | 73/862.54 |
| 4,289,467 | 9/1981 | Pesch | 425/150 |
| 4,367,655 | 1/1983 | Blüml et al. | 73/862.54 |

FOREIGN PATENT DOCUMENTS

| | | | |
|---|---|---|---|
| 1703297 | 2/1972 | Fed. Rep. of Germany | 100/46 |

*Primary Examiner*—Peter Feldman
*Attorney, Agent, or Firm*—Karl F. Ross; Herbert Dubno

[57] ABSTRACT

A platen press has upper and lower platens each provided with at least one rigidifying beam. A group of hydraulic cylinders spaced about over one of the platens serves to urge the two platens together in a pressing direction to compress a workpiece—plywood, fiber mat, chipboard, or the like—between the platens. During pressing the platens and their rigidifying beams bend somewhat. This bending is measured by an apparatus which comprises a flexible strand, holders at the ends of the one beam for gripping the ends of the strand and holding same straight and under tension, and sensors fixed on the one beam at a location between the ends of the one beam for measuring the displacement of the strand relative to the beam at the location during pressing. This sensor lies wholly out of physical contact with the strand.

10 Claims, 3 Drawing Figures

APPARATUS FOR MEASURING PLATEN-PRESS BEND IN PLATEN PRESS

FIELD OF THE INVENTION

The present invention relates to a platen press. More particularly this invention concerns an apparatus for measuring the bend of a platen of a platen press.

BACKGROUND OF THE INVENTION

A standard platen press has upper and lower platens each provided with at least one rigidifying beam. Means such as a group of powerful hydraulic cyliners spaced about over one of the platens serves to urge the two platens together in a pressing direction to compress a workpiece—plywood, fiber mat, chipboard, or the like—between the platens. During pressing it is inevitable that the platens and their rigidifying beams bend somewhat. It has been found impractical to use beams so rigid that they do not bend at all under the normal relatively high pressing forces; such platens would be unusably large and heavy.

The faces of the platens must be parallel during the pressing operation, however, in order to produce a product whose faces are parallel, as is invariably required. The simplest way of achieving this planarity is to use press platens that are bowed slightly to start with, but that flatten out to a planar shape when deformed during pressing, or to use an appropriately shaped insert between the platen beams and the platen.

Recent times have, however, required that the workpieces be to very high tolerances. The prior-art system of nonplanar platens cannot meet such requirements, so recourse has been had to various systems for measuring the platen deformation so that the pressure in the appropriate cylinders can be increased to hold the platens in planar shape.

German patent document 1,703,297 filed Apr. 29, 1968 under serial P1,703,297.2 describes a complex system wherein actuation cylinders are distributed over the surface of the platen. This system has a plurality of reference bars extending parallel to the platens and immediately behind them. These reference bars are supported only at their ends and are normally perfectly straight. Each engages a plurality of sensors carried on the respective platen and connected to respective valves that control respective compensating cylinders. When a platen bends so that at one region it, for instance, approaches the bar, the respective sensor operates the respective valve to change pressure in the respective compensating cylinder to compensate out the deformation.

Such an arrangement is quite complex and has not shown itself to operate with the high degree of accuracy, plus or minus 1 micron, it is supposed to have. The bars frequently are deformed thermally in the normally heated press, and often droop with time so that the readings they give become meaningless. The mountings at their ends are not without friction, so that as the platens deform some of this deformation is transmitted to these bars, worsening the accuracy of the system. The considerable expense of this system, coupled with it relatively poor accuracy, has mitigated against its widespread use.

OBJECTS OF THE INVENTION

It is therefore an object of the present invention to provide an improved platen-bend measurer for a platen press.

Another object is the provision of such a platen-bend measurer for a platen press which overcomes the above-given disadvantages.

Yet another object is to provide an apparatus for measuring the bend in a platen of a platen press which is relatively simple, which gives highly accurate readings, and which can be assured of having a long service life.

SUMMARY OF THE INVENTION

These objects are attained according to the instant invention in an apparatus for measuring the bending of one of the beams of a platen press as described above which comprises a flexible strand, holder means at the ends of the one beam for gripping the ends of the strand and holding same straight and under tension, and sensor means fixed on the one beam at a location between the ends of the one beam for measuring the displacement of the strand relative to the beam at the location during pressing. The sensor means lies wholly out of physical contact with the strand.

The use of a tensioned flexible strand insures that this strand will be perfectly straight under all normally encountered circumstances. The temperature or bending of the platen it is carried on will not affect it. Neither will the sensor that measures its displacement, as this element does not physically touch it. This system is therefore capable of operating with an accuracy hitherto unobtainable.

The press of this invention further comprises means for thermally modulating—that is heating or cooling—the platens. It is in such heated or cooled press platens that the prior-art systems normally are most inaccurate due to the thermal deformations of the platens and associated elements.

According to another feature of this invention the strand is a metal band and the means operates inductively. It is also possible for the strand to be a nonmetallic band and for the means to operate capacitatively. Either way it is possible to measure the strand position relative to the respective location on the beam with great accuracy. The band is normally flat and has a section maintained by the holders parallel to the respective platen, so that the deformation direction of the platen relative to this section will be perpendicular to it.

The means of the invention is substantially equidistant between the ends of the one beam. Thus the deflection at the point of maximum deflection is measured. It is also possible to provide a bend measurer on each of the beams, and even to have them crossing each other to measure deflection in several locations. In fact the bend measurer of this invention can extend transverse to the main beams of the platen, or even diagonally across the platen. Since a platen is normally constructed uniformly, and since the load it is subject to is distributed uniformly over it, its deformation is similarly uniform—typically only constituting a simple bowing at the middle—so that extensive sampling of this bending is not usually necessary.

One of the holders of the system according to this invention includes spring means for maintaining the strand under tension. This simple expedient keeps the strand tight and straight even when the respective beam bows greatly to perceptibly reduce the distance between its ends.

The sensor according to this invention is connected as described in the above-discussed German patent document to a valve which controls a compensating cylinder. Thus when a certain deflection is sensed at a location the respective compensating cylinder can be pressurized to compensate for it, until the distance between the beam and the strand at that location is back to what it should be.

DESCRIPTION OF THE DRAWING

The above and other features and advantages will become more readily apparent from the following, reference being made to the accompanying drawing in which.

SPECIFIC DESCRIPTION

Figure 1:
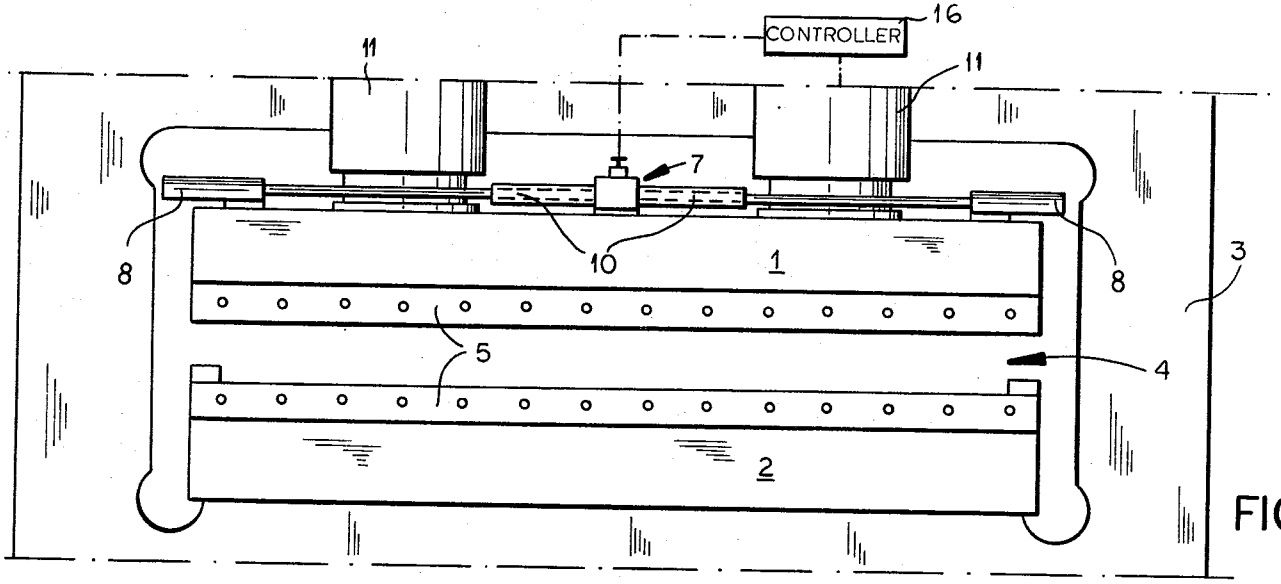
FIG. 1 is a vertical section through a platen press according to this invention.
Figure 2:
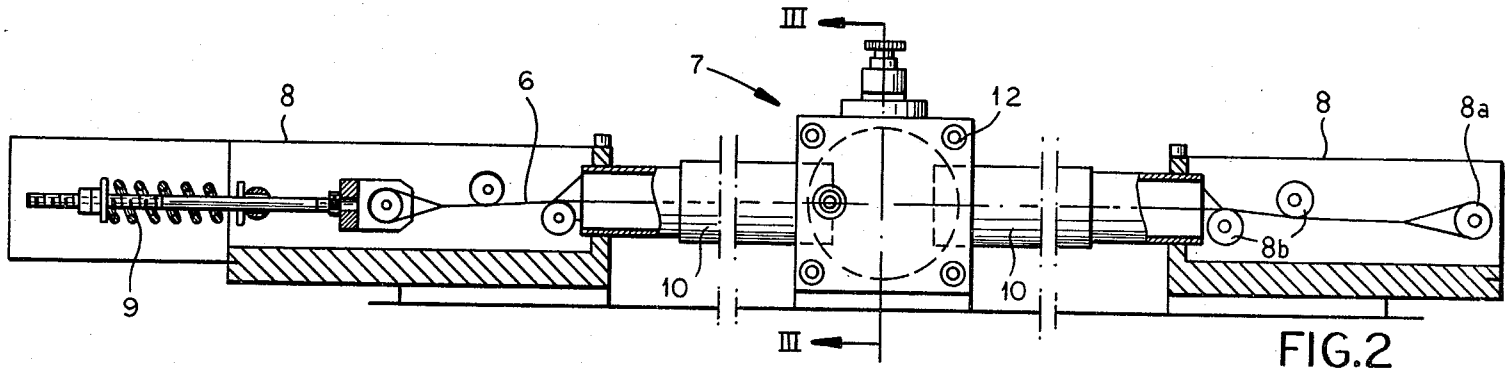
FIG. 2 is a large-scale view of a detail of FIG. 1.

A platen press has upper press beams 1 and lower press beams 2 surrounded by a press frame 3 and defining a working gap 4 as seen in FIG. 1. The beams 1 and 2 carry heatable or coolable press platens 5. Cylinders 11 can urge the upper beams 1 and platen 5 down toward the lower beams and platen 2 to press a workpiece in the gap 4 as is well known in the art.

A flexible band 6 is stretched tight between holders 8 on the ends of one of the upper beams 1 and passes through a sensor 7. One of these holders merely has an end anchor roller 8*a* and two positioning rollers 8*b*. The other has a similar set of rollers 8*a* and 8*b*, but the anchor roller 8*a* is pulled away from the other anchor roller 8*a* by a spring 9 that keeps considerable tension in the strand or band 6. A pair of telescoping tubes 10 loosely surround and protect the strand 6 between the holders 8 and the housing 12 of the sensor 7.

Figure 3:
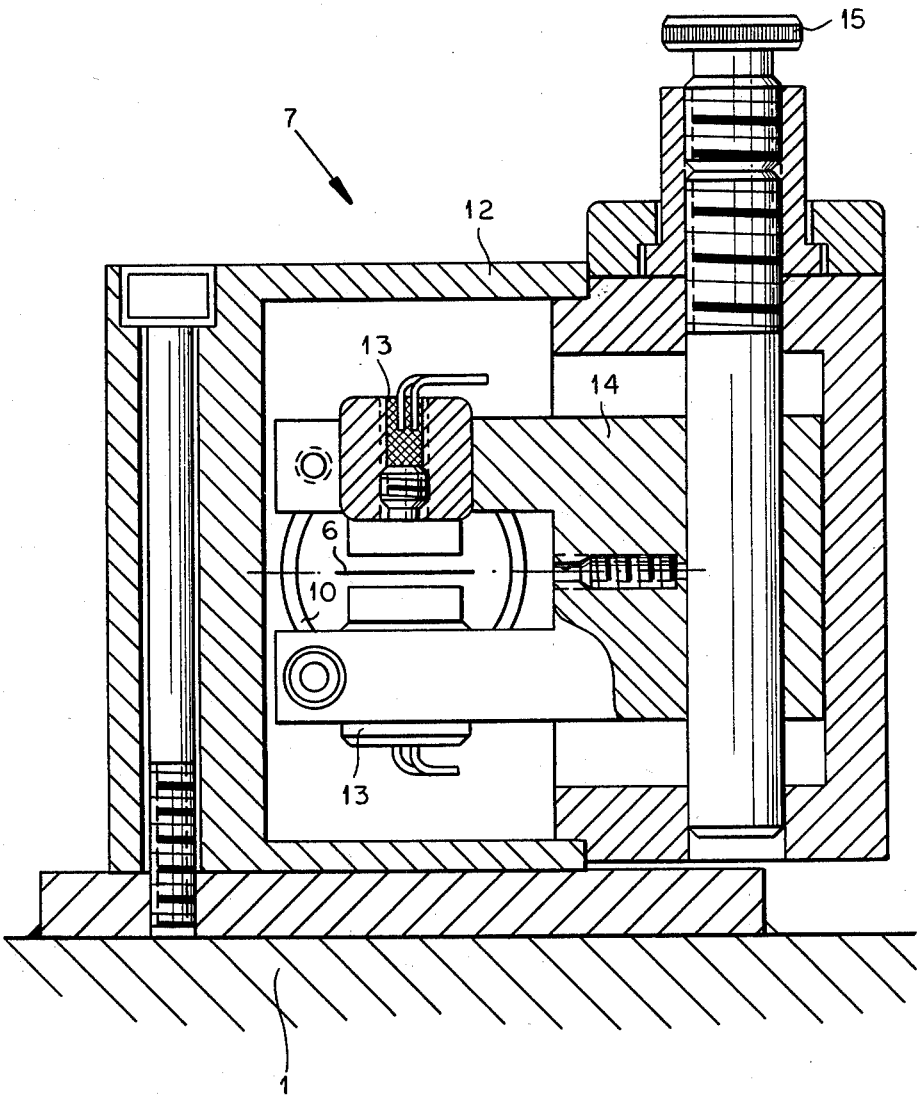
FIG. 3 is a section taken along line III—III of FIG. 2.

This sensor 7, as seen in FIG. 3 has a pair of transducers 13 carried on a yoke-type support 14 to vertically flank the flat band 6. An adjustment knob 15 can vertically position the support 14 in the housing 12.

The strand 6 can be a flat steel strip and the transducers 13 can be inductive coils. The vertical position of the support 14 is adjusted when the respective beam 1 is perfectly straight to obtain the same reading from both of the transducers 13, that is when the band 6 is perfectly midway between them. It is also possible to use a synthetic-resin band 6 and capacitative sensor 13. Either way the band is flat and arranged to be parallel to the platen when same is straight.

When, for instance, the center of the beam 1 bends up the band 6 will move toward the lower transducer 13, thereby inversely varying the output signal from it and from the upper transducer. An appropriately positioned cylinder 11 can then be operated by an appropriate controller 16 to respond by pushing down the appropriate location on the top of the beam to make it straight again. Pressure is increased in this cylinder until the signals of the two transducers 13 are again equal, signalling that the beam 1 is straight.

It is of course possible to mount such a bend measurer on any of the beam 1 and 2. In fact one could extend perpendicularly across the beams 1 and 2 or even diagonally of the respective platen 5. The point is that the strand is a flexible one that is held under tension so that it is straight under all circumstances, and that the sensor is mounted on the beam or platen to move with it as it deforms. Since the cylinders 11 normally bear on the beams 1, it is most convenient to take the measurements at this beam 1 so that corrective action can be taken at the exact location where the sensing is done.

With this system the temperature of the strand 6 is wholly irrelevant. Since it is flexible, but relatively inextensible, it will remain perfectly straight under all circumstances and will allow extremely accurate readings of the bending of the beam 1 to be made. Once originally calibrated by means of the knob 15, it will normally stay calibrated for a long time, while giving accurate readings. Since measurer has no moving mechanical parts except that tensioning-spring arrangement 9, it can further be counted on to have an extremely long service life.

We claim:

1. In a platen press having:

a press frame;

an upper press platen having at least one elongated beam;

a lower press platen having at least one elongated beam; and means for urging said platens toward each other in a pressing direction to compress a workpiece therebetween, whereby said elongated beams may bend during such compression, an apparatus for measuring the bending of one of said beams, said apparatus comprising:

a flexible strand;

holder means at the ends of said one beam for gripping the ends of said strand and holding same straight and under tension; and sensor means fixed on said one beam at a location between the ends of said one beam for measuring the displacement of said strand relative to said beam at said location during pressing, said sensor means lying wholly out of physical contact with said strand.

2. The combination defined in claim 1, further comprises means for thermally modulating said platens.

3. The combination defined in claim 2 wherein said strand is a metal band and said sensor means operates inductively.

4. The combination defined in claim 2 wherein said strand is a nonmetallic band and said sensor means operates capacitatively.

5. The combination defined in claim 2 wherein said sensor means is substantially equidistant between said ends of said one beam.

6. The combination defined in claim 2 wherein one of said holders includes spring means or maintaining said strand under tension.

7. The combination defined in claim 2 wherein said means for modulating includes means for heating said platens.

8. The combination defined in claim 2 wherein said strand is a flat band and has a section between said holders that is planar and parallel to the respective platen.

9. The combination defined in claim 8 wherein said sensor means includes a pair of sensors flanking said section.

10. The combination defined in claim 9 wherein when said respective platen is planar said section is equidistant between said sensors.

* * * * *